US009181510B2

(12) United States Patent
Barton et al.

(10) Patent No.: US 9,181,510 B2
(45) Date of Patent: Nov. 10, 2015

(54) LUBRICATING COMPOSITION CONTAINING A DISPERSANT

(75) Inventors: William R. S. Barton, Belper (GB); David Price, Littleover (GB); Patrick E. Mosier, Bay Village, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 140 days.

(21) Appl. No.: 13/698,293

(22) PCT Filed: May 19, 2011

(86) PCT No.: PCT/US2011/037106

§ 371 (c)(1), (2), (4) Date: Jan. 31, 2013

(87) PCT Pub. No.: WO2011/146692

PCT Pub. Date: Nov. 24, 2011

(65) Prior Publication Data

US 2013/0143781 A1 Jun. 6, 2013

Related U.S. Application Data

(60) Provisional application No. 61/346,501, filed on May 20, 2010.

(51) Int. Cl.

| | |
|---|---|
| ***C10M 149/00*** | (2006.01) |
| ***C10M 159/12*** | (2006.01) |
| ***C10M 133/16*** | (2006.01) |
| ***C10M 149/06*** | (2006.01) |
| ***C10M 159/00*** | (2006.01) |

(52) U.S. Cl.

CPC ..... *C10M 133/16* (2013.01); *C10M 149/06* (2013.01); *C10M 159/005* (2013.01); *C10M 2205/022* (2013.01); *C10M 2205/024* (2013.01); *C10M 2205/026* (2013.01); *C10M 2205/028* (2013.01); *C10M 2207/028* (2013.01); *C10M 2207/262* (2013.01); *C10M 2209/084* (2013.01); *C10M 2215/086* (2013.01); *C10M 2215/28* (2013.01); *C10M 2217/06* (2013.01); *C10M 2219/046* (2013.01); *C10M 2219/089* (2013.01); *C10N 2220/022* (2013.01); *C10N 2230/04* (2013.01); *C10N 2230/45* (2013.01); *C10N 2230/52* (2013.01); *C10N 2240/10* (2013.01); *C10N 2240/101* (2013.01); *C10N 2240/102* (2013.01); *C10N 2240/103* (2013.01); *C10N 2240/104* (2013.01); *C10N 2240/105* (2013.01)

(58) Field of Classification Search

CPC ..... C10M 2205/028; C10M 2209/086; C10M 133/16; C10M 159/005; C10M 149/06; C10M 2205/022; C10M 2219/089; C10M 2209/084; C10M 2219/046; C10M 2207/262; C10M 2217/06; C10M 2205/026; C10M 2215/086; C10M 2215/28; C10M 2207/028; C10M 2205/02; C10N 2260/06; C10N 2260/09; C10N 2240/102; C10N 2240/10; C10N 2230/04; C10N 2230/45; C10N 2240/101; C10N 2240/104; C10N 2220/022; C10N 2230/52; C10N 2240/103; C10N 2240/105

USPC ..... 508/296, 306, 400

See application file for complete search history.

(56) References Cited

U.S. PATENT DOCUMENTS

| | | | | |
|---|---|---|---|---|
| 3,702,300 | A | 11/1972 | Coleman | |
| 4,136,040 | A | 1/1979 | DeVries et al. | |
| 4,863,623 | A | 9/1989 | Nalesnik | |
| 5,182,041 | A | 1/1993 | Benfarmeo et al. | |
| 5,264,139 | A | 11/1993 | Mishra | |
| 5,264,140 | A | 11/1993 | Mishra | |
| 5,409,623 | A | 4/1995 | Mishra et al. | |
| 5,620,486 | A | 4/1997 | Cherpeck | |
| 5,744,429 | A * | 4/1998 | Chung et al. | 508/221 |
| 6,051,537 | A | 4/2000 | Emert et al. | |
| 6,107,257 | A * | 8/2000 | Valcho et al. | 508/221 |
| 6,107,258 | A | 8/2000 | Esche et al. | |
| 6,117,825 | A | 9/2000 | Liu et al. | |
| 8,168,574 | B2 * | 5/2012 | Visger et al. | 508/500 |
| 2006/0247386 | A1 * | 11/2006 | Ruhe et al. | 525/379 |
| 2008/0026972 | A1 * | 1/2008 | Mathur et al. | 508/545 |
| 2009/0305923 | A1 | 12/2009 | Visger et al. | |

FOREIGN PATENT DOCUMENTS

| | | | |
|---|---|---|---|
| WO | WO 2005087821 | A2 * | 9/2005 |
| WO | 2005/103093 | A2 | 11/2005 |
| WO | WO 2005103093 | A2 * | 11/2005 |
| WO | 2010/014655 | A1 | 2/2010 |
| WO | 2010/062842 | | 6/2010 |

OTHER PUBLICATIONS

Corresponding International Publication No. WO 2011/146692 A1 & Search Report published Nov. 24, 2011.

Written Opinion from corresponding International Application No. PCT/US2011/037106 dated Aug. 3, 2011.

* cited by examiner

*Primary Examiner* — Pamela H Weiss

(74) *Attorney, Agent, or Firm* — Deron A. Cook, Esq.; David M. Shold, Esq.; Teresan W. Gilbert, Esq.

(57) ABSTRACT

The invention provides a lubricating composition containing a copolymer comprising units derived from monomers (i) α-olefin and (ii) an ethylenically unsaturated carboxylic acid or derivatives thereof esterified and amidated with an alcohol and an aromatic amine respectively, and an oil of lubricating viscosity. The invention further relates to the use of the lubricating composition in an internal combustion engine.

13 Claims, No Drawings

LUBRICATING COMPOSITION CONTAINING A DISPERSANT

FIELD OF INVENTION

The invention provides a lubricating composition containing a co-polymer comprising units derived from monomers (i) an α-olefin and (ii) an ethylenically unsaturated carboxylic acid or derivatives thereof esterified and amidated with an alcohol and an aromatic amine respectively, and an oil of lubricating viscosity. The invention further relates to the use of the lubricating composition in an internal combustion engine.

BACKGROUND OF THE INVENTION

Engine manufacturers have focused on improving engine design in order to minimise emissions of particulates and pollutants, and improve cleanliness and fuel economy. One of the improvements in engine design is the use of exhaust gas recirculation (EGR) engines. Heavy duty diesel vehicles may use exhaust gas recirculation (EGR) engines in efforts to reduce environmental emissions. Whilst improvements in engine design and operation have contributed to reducing emissions, some engine design advances are believed to have generated other challenges for the lubricant. For example, EGR is believed to have led to increased formation and/or accumulation of soot and sludge. Among the consequences of recirculating the exhaust gas through the engine are different soot structures and increased viscosity of the oil at lower soot levels, compared with engines without EGR.

Increased soot-mediated oil thickening is common in heavy duty diesel engines. Some diesel engines employ EGR. The soot formed in an EGR engine has different structures and causes increased viscosity of engine lubricant at lower soot levels than formation of soot in the engine without an EGR.

Viscosity improvers are often used to reduce the extent of the decrease in viscosity as the temperature is raised or to reduce the extent of the increase in viscosity as the temperature is lowered, or both. Thus, a viscosity improver ameliorates the change of viscosity of an oil containing it with changes in temperature.

Dispersant viscosity modifiers (DVMs) made from ethylene-propylene copolymers that have been radically grafted with maleic anhydride and reacted with various amines have shown desirable performance to prevent oil thickening in diesel engines. Aromatic amines are said to show good performance in this regard. DVMs of this type are disclosed in, for instance, U.S. Pat. Nos. 4,863,623, 5,264,139, 5,264,140, 5,620,486, 6,107,257, 6,107,258, and 6,117,825.

U.S. Pat. No. 5,409,623 discloses functionalized graft copolymers as viscosity index improvers, comprising an ethylene alpha-monoolefin copolymer grafted with an ethylenically unsaturated carboxylic acid material and derivatized with an azo-containing aromatic amine compound.

U.S. Pat. Nos. 5,264,139 and 5,264,140 disclose polymers derivatized with a sulphonyl-containing aromatic amine and an amide-containing aromatic amine material, respectively.

Other dispersant viscosity modifiers have been contemplated in a variety of applications including U.S. patent application Ser. Nos. 11/568,051 and 61/118,012; and International Application WO publication WO 2010/014655 A1.

U.S. patent application Ser. No. 11/568,051 discloses soot dispersants derived from esterified maleic anhydride-styrene interpolymers functionalized with nitrogen-containing moieties.

International publication WO 2010/014655 A1 discloses alpha olefin maleic anhydride (AOMA) interpolymers which may be esterified and further functionalized with amines having at least one condensable N—H group.

International publication WO 2005/103093 discloses an esterified, nitrogen-functionalized interpolymer composition derived from monomers comprising (i) at least one monomer selected from (a) vinyl aromatic monomers and (b) aliphatic olefins containing 2 to about 30 carbon atoms, and (ii) at least one α,β-unsaturated acylating agent, wherein a portion of said acylating agentderived units is esterified, and wherein a portion of said acylating agent-derived units is condensed with at least one aromatic amine containing at least one >N—H group capable of condensing with said acylating agent monomer-derived unit. The interpolymer explicitly disclosed is derivable from monomer units styrene and maleic anhydride.

U.S. application 61/118,012 (also relating to International Patent Application WO2010/062842) discloses olefin polymers functionalized by grafting with an unsaturated carboxylic acid material and derivatized with aromatic amines having three or more non-contiguous aromatic groups.

Other publications disclose the possibility of dispersants with aromatic groups.

U.S. Pat. No. 5,182,041 discloses polyolefin based dispersants functionalized with an ethylenically unsaturated acylating agent and reacted with an amino-aromatic polyamines to produce antioxidant dispersants.

U.S. Pat. No. 6,051,537 discloses hydrocarbyl dispersants made from polyolefins functionalized with monounsaturated mono acid materials selected from acrylic acid, methacrylic acid and cinnamic acid reacted with amines, alcohols and/or aminoalcohols. These polyolefins have number average molecular weight in the range 1500 to 5000.

SUMMARY OF THE INVENTION

An objective of the present invention is to provide a lubricating composition capable of providing at least one of (i) a lubricating composition capable of reducing viscosity increase (often having a viscosity of less than 12 $mm^2$/sec (cSt) at 100° C. at a soot loading of 6 weight % or more), and/or (ii) a lubricating oil composition that maintains a relatively stable viscosity over a wide range of temperatures, which could be desirable because viscosity index improvers or DVMs may be employed to control viscosity over a wide temperature range and to control soot, and/or (iii) oxidation control. It may also be desirable if a viscosity index improver were capable of achieving (i) and (ii).

Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

In one embodiment the present invention provides a lubricating composition comprising an oil of lubricating viscosity and a copolymer comprising units derived from monomers (i) an α-olefin and (ii) an ethylenically unsaturated carboxylic acid or derivatives thereof esterified and amidated with an alcohol and an aromatic amine respectively.

The copolymer may optionally be amidated with a non-aromatic amine. When the copolymer is amidated with a non-aromatic amine, the resultant copolymer is amidated with a mixture of an aromatic amine and a non-aromatic amine.

The copolymer may also be described as an interpolymer.

The alcohol may provide an esterified group with an average number of carbons of 4 or more, or 6 or more, or 8 or more. The average number of carbon atoms may range from 4 to 40, or 6 to 20, or 8 to 16.

In one embodiment the aromatic amine provides to the copolymer of the invention 0.01 wt % to 2 wt % (or 0.05 wt % to 0.75 wt %, or 0.075 wt % to 0.25 wt %) nitrogen.

In one embodiment the present invention provides a lubricating composition comprising an oil of lubricating viscosity and a copolymer comprising units derived from monomers (i) an α-olefin and (ii) an ethylenically unsaturated carboxylic acid or derivatives thereof esterified and amidated with an alcohol and an aromatic amine respectively (typically wherein the aromatic amine is not a heterocycle).

In one embodiment the present invention provides a lubricating composition comprising (a) an oil of lubricating viscosity, (b) a copolymer comprising units derived from monomers (i) an α-olefin, and (ii) an ethylenically unsaturated carboxylic acid or derivatives thereof esterified and amidated with an alcohol and an aromatic amine respectively, and (c) an overbased metal-containing detergent.

In one embodiment the lubricating composition disclosed herein has a sulphated ash content of 0.3 wt % to 1.2 wt %, or 0.5 wt % to 1.1 wt % of the lubricating composition. The sulphated ash content may be determined by ASTM D-874.

In one embodiment the invention provides a lubricating composition wherein the copolymer may be present at 0.1 wt % to 70 wt %, or 1 wt % to 65 wt %, or 2 wt % to 60 wt %, or 2 wt % to 20 wt % of the lubricating composition.

In one embodiment the invention provides a lubricating composition comprising the compound disclosed herein and an alkylated diarylamine (such as an alkylated diphenylamine, or an alkylated phenylnapthylamine). The alkylated diphenylamine may include di-nonylated diphenylamine, nonyl diphenylamine, octyl diphenylamine, di-octylated diphenylamine, di-decylated diphenylamine, decyl diphenylamine and mixtures thereof. In one embodiment the diphenylamine may include nonyl diphenylamine, dinonyl diphenylamine, octyl diphenylamine, dioctyl diphenylamine, or mixtures thereof. In one embodiment the diphenylamine may include nonyl, diphenylamine, or dinonyl diphenylamine. The alkylated diarylamine may include octyl, di-octyl, nonyl, di-nonyl, decyl or di-decyl phenylnapthylamines.

When present, the alkylated diphenylamine may be present at 0.05 wt % to 5 wt %, or 0.1 wt % to 3 wt %, or 0.5 wt % to 2 wt % of the lubricating composition.

In one embodiment the invention provides a lubricating composition wherein the compound as disclosed herein may be present at 2 wt % to 12 wt % (or typically 4 wt % to 9) wt % and the alkylated diphenylamine may be present at 0.1 wt % to 3 wt % (or typically 0.5 wt % to 2 wt %) of the lubricating composition.

In one embodiment the invention provides a method of lubricating an internal combustion engine comprising supplying to the internal combustion engine a lubricating composition as disclosed herein.

In one embodiment the invention provides for the use of the compound described herein in a lubricant as a dispersant viscosity modifier or a dispersant viscosity modifier booster.

In one embodiment the invention provides for the use of the copolymer disclosed herein in a lubricant as a dispersant viscosity modifier or a dispersant viscosity modifier booster in an internal combustion engine lubricant. Typically a dispersant viscosity modifier is useful to mitigate soot thickening in an engine lubricant.

DETAILED DESCRIPTION OF THE INVENTION

The present invention provides a lubricating composition, a method for lubricating an engine as disclosed above, and a use of the compound as disclosed above.

Copolymer

The copolymer of the invention may be prepared by the reaction of monomers (i) an α-olefin and (ii) an ethylenically unsaturated carboxylic acid or derivatives thereof.

The α-olefin may be a linear or branched olefin, or mixtures thereof. If the α-olefin is linear, the number of carbon atoms of the α-olefin may range from 2 to 20, or 4 to 16, or 8 to 12. If the α-olefin is branched, the number of carbon atoms of the α-olefin may range from 4 to 32, or 6 to 20, or 8 to 16. Examples of an α-olefin include 1-decene, 1-undecene, 1-dodecene, 1-tridecene, 1-tetradecene, 1-pentadecene, 1-hexadecene, 1-heptadecene 1-octadecene, or mixtures thereof. An example of a useful α-olefin is 1-dodecene.

The ethylenically unsaturated carboxylic acid or derivatives thereof may be an acid or anhydride or derivatives thereof that may be partially esterified. When partially esterified, other functional groups include acids, salts, imides, and amides, or mixtures thereof. Suitable salts include alkali metals, alkaline earth metals or mixtures thereof. The salts include lithium, sodium, potassium, magnesium, calcium or mixtures thereof. The unsaturated carboxylic acid or derivatives thereof includes cis-cinnamic acid, trans-cinnamic acid, acrylic acid, methyl acrylate, methacrylic acid, maleic acid or anhydride, fumaric acid, itaconic acid or anhydride or mixtures thereof, or substituted equivalents thereof.

Examples of the ethylenically unsaturated carboxylic acid or derivatives thereof include itaconic anhydride, maleic anhydride, methyl maleic anhydride, ethyl maleic anhydride, dimethyl maleic anhydride, (meth)acrylic acid, or mixtures thereof. In one embodiment the ethylenically unsaturated carboxylic acid or derivatives thereof includes maleic anhydride or derivatives thereof.

The copolymer may be prepared as is described in International publication WO2010/014655 A. For example, the copolymer of the invention prepared by the reaction of monomers (i) an α-olefin and (ii) an ethylenically unsaturated carboxylic acid or derivatives thereof are described in paragraph [0140] to [0141] of WO2010/014655 A. The copolymer may, in one embodiment, be a copolymer derived from 1-dodecene and maleic anhydride. Exemplified copolymers include those prepared below.

The copolymer may also be prepared by processes similar to those described in International publication WO2005/103093, except the styrene is replaced with the α-olefin.

The copolymer may also be obtained/obtainable by a process comprising:

(1) reacting monomers (i) an α-olefin and (ii) an ethylenically unsaturated carboxylic acid or derivatives thereof to form a copolymer;

(2) reacting the copolymer of (i) with an alcohol to form an esterified copolymer; and (3) reacting the product of step (2) with an aromatic amine, and optionally a non-aromatic amine, to form a copolymer that is amidated and esterified.

The copolymer may also be obtained/obtainable by a process comprising:

(1) reacting monomers (i) an α-olefin and (ii) an ethylenically unsaturated carboxylic acid or derivatives thereof to form a copolymer;

(2) reacting the product of step (1) with an aromatic amine and optionally a non-aromatic amine; and (3) reacting the copolymer of step (2) with an alcohol, to form a copolymer that is amidated and esterified.

In one embodiment the processes above process further comprise reacting a non-aromatic amine in step (3) and (2) respectively, or optionally after step (3) in either case.

In one embodiment the aromatic amine (and optionally non-aromatic amine) is present in an amount sufficient to provide the copolymer of the invention with 0.01 wt % to 2 wt % (or 0.05 wt % to 0.1 wt %, or 0.075 wt % to 0.75 wt %) of nitrogen.

In one embodiment the aromatic amine may be present in an amount such that there are 1 mol % to 20 mol %, or 3 mol % to 10 mol % of aromatic amine per unsaturated acid monomers.

The polymerisation process to form the product of step (1) may be through solution free-radical polymerisation. The product of step (1) may be formed by processes known in the art. For example the mole ratio of α-olefin and (ii) an ethylenically unsaturated carboxylic acid or derivatives thereof may be 1:2 to 3:1, or 1:1.

Prior to amidation or esterification the copolymer may have a reduced specific viscosity (RSV) of up to 0.15, or up to 0.12, or up to 0.1 or up to 0.08. Examples of RSV ranges may include 0.01 to 0.15, or 0.015 top 0.12, 0.02 to 0.1, or 0.02 to 0.08, or 0.02 to 0.07, 0.03 to 0.07 or 0.04 to 0.06. Typically the RSV ranges described herein are based on the mean of three measurements made on the copolymer.

The copolymer may instead of RSV be defined in terms of weight average molecular weight. Typically the weight average molecular weight is measured on the final esterified and amidated copolymer. The weight average molecular weight may be 5000 to 30,000, or 8000 to 21,000.

The copolymer reduced specific viscosity (RSV) is measured by the formula RSV=(Relative Viscosity−1)/Concentration, wherein the relative viscosity is determined by measuring, by means of a dilution viscometer, the viscosity of a solution of 1.6 g of the copolymer in 100 $cm^3$ of acetone and the viscosity of acetone at 30° C. A more detailed description of RSV is provided below. The RSV is determined for the copolymer of an α-olefin and (ii) an ethylenically unsaturated carboxylic acid or derivatives thereof before esterification.

Copolymer Backbone Preparation: A copolymer is prepared by reacting in a 3 litre flask 1 mole of maleic anhydride, and Y moles (defined below) of 1-dodecene in the presence of 60 wt % of toluene solvent. The flask is fitted with a flange lid and clip, PTFE stirrer gland, rod and overhead stirrer, thermocouple, nitrogen inlet port and water-cooled condenser. Nitrogen is blown through the flask at 0.028 $m^3$/hr (or 1 SCFH or 28 L/hr). A separate 500 ml flask with a side arm is charged with 0.05 moles of tert-butyl peroxy-2-ethylhexanoate initiator (a commercially available initiator from Akzo Nobel, known as Trigonox®21S), optionally n-dodecyl mercaptan (chain transfer agent, CTA) and additional toluene. A nitrogen line is fitted to the arm and nitrogen is applied at 0.0085 $m^3$/hr (or 0.3 SCFH) for 30 minutes. The 3 litre flask is heated to 105° C. The Trigonox 21S initiator/toluene mixture is pumped from the 500 mL flask into the 3 litre flask via a Masterflex™ pump (flow rate set at 0.8 ml/min) over a period of 5 hours. The contents of the 3 litre flask are stirred for 1 hour before cooling to 95° C. The contents of the 3 litre flask are stirred overnight. Typically a clear colourless gel is obtained. The amount of each reagent is shown in the table below.

The copolymers prepared are characterised by RSV method described in the description above. The RSV data is presented in the table.

| Copolymer Prep Example | Y moles of 1-Dodecene | Mole Ratio of CTA to Initiator | RSV |
|---|---|---|---|
| Cpp1 | 1 | 0:1 | 0.058 |
| Cpp2 | 0.95 | 0:1 | 0.071 |
| Cpp3 | 0.93 | 0:1 | 0.077 |
| Cpp4 | 0.91 | 0:1 | 0.065 |
| Cpp5 | 0.90 | 0:1 | 0.060 |
| Cpp6 | 0.85 | 0:1 | 0.071 |
| Cpp7 | 0.80 | 0:1 | 0.067 |
| Cpp8* | 1 | 0.6:1 | N/M |

Footnote:
N/M is not measured.
*For Cpp8 the amount of toluene solvent added is 55 wt % and not 60 wt % quoted for other syntheses.

The copolymer may optionally be prepared in the presence of a free radical initiator, solvent, chain transfer agent, or mixtures thereof. A person skilled in the art will appreciate that altering the amount of initiator and/or chain transfer agent will alter the number average molecular weight and RSV of the copolymer of the invention.

The solvent is known and is normally a liquid organic diluent. Generally, the solvent has as a boiling point thereof high enough to provide the required reaction temperature. Illustrative diluents include toluene, t-butyl benzene, benzene, xylene, chlorobenzene and various petroleum fractions boiling above 125° C.

The free radical initiator is known and includes peroxy compounds, peroxides, hydroperoxides, and azo compounds which decompose thermally to provide free radicals. Other suitable examples are described in J. Brandrup and E. H. Immergut, Editor, "Polymer Handbook", 2nd edition, John Wiley and Sons, New York (1975), pages II-1 to II-40. Examples of a free radical initiator include those derived from a free radical-generating reagent, and examples include benzoyl peroxide, t-butyl perbenzoate, t-butyl metachloroperbenzoate, t-butyl peroxide, sec-butylperoxydicarbonate, azobisisobutyronitrile, t-butyl peroxide, t-butyl hydroperoxide, t-amyl peroxide, cumyl peroxide, t-butyl peroctoate, t-butyl-m-chloroperbenzoate, azobisisovaleronitrile or mixtures thereof. In one embodiment the free radical generating reagent is t-butyl peroxide, t-butyl hydroperoxide, t-amyl peroxide, cumyl peroxide, t-butyl peroctoate, t-butyl-m-chloroperbenzoate, azobisisovaleronitrile or mixtures thereof. Commercially available free radical initiators include classes of compound sold under the trademark Trigonox®-21 from Akzo Nobel.

The chain transfer agent is known to a person skilled in the art. The chain transfer agent may be added to a polymerisation as a means of controlling the molecular weight of the polymer. The chain transfer agent may include a sulphur-containing chain transfer agent such as n- and t-dodecyl mercaptan, 2-mercapto ethanol, methyl-3-mercaptopropionate. Terpenes can also be used. Typically the chain transfer agent may be n- and t-dodecyl mercaptan.

The alcohol may be a linear or branched alcohol, a cyclic or acyclic alcohol, or a combination of features thereof. The alcohol typically reacts with the ethylenically unsaturated carboxylic acid or derivatives thereof to form esterified groups.

The esterified groups may be derivable from linear or branched alcohols. The alcohol may have 1 to 150, or 4 to 50, 2 to 20, 8 to 20 (such as 4 to 16, or 8 to 12) carbon atoms. Typically the number of carbon atoms is sufficient to make the copolymer of the invention dispersible or soluble in oil.

In different embodiments the alcohol may be a primary alcohol branched at the β- or higher position and may have at least 12 (or at least 16, or at least 18 or at least 20) carbon atoms. The number of carbon atoms may range from at least 12 to 60, or at least 16 to 30.

The alcohol may be a fatty alcohol of various chain lengths (typically containing 6 to 20, or 8 to 18, or 10 to 15 carbon atoms). The fatty alcohol includes Oxo Alcohol® 7911, Oxo Alcohol® 7900 and Oxo Alcohol® 1100 of Monsanto; Alphanol® 79 of ICI; Nafol® 1620, Alfol® 610 and Alfol® 810 of Condea (now Sasol); Epal® 610 and Epal® 810 of Ethyl Corporation; Linevol® 79, Linevol® 911 and Dobanol® 25 L of Shell AG; Lial® 125 of Condea Augusta, Milan; Dehydad® and Lorol® of Henkel KGaA (now Cognis) as well as Linopol® 7-11 and Acropol® 91 of Ugine Kuhlmann.

The esterified groups may be derivable from a branched alcohol with branching at the β- or higher position. In one embodiment the branched alcohol may be a Guerbet alcohol, or mixtures thereof. Guerbet alcohols typically have carbon chains with branching at the β-position. The Guerbet alcohols may contain 10 to 60, or 12 to 60, or 16 to 40 carbon atoms. Methods to prepare Guerbet alcohols are disclosed in U.S. Pat. No. 4,767,815 (see column 5, line 39 to column 6, line 32).

The Guerbet alcohols may have alkyl groups including the following:

1) alkyl groups containing $C_{15-16}$ polymethylene groups, such as 2-$C_{1-15}$ alkyl-hexadecyl groups (e.g. 2-octylhexadecyl) and 2-alkyl-octadecyl groups (e.g. 2-ethyloctadecyl, 2-tetradecyl-octadecyl and 2-hexadecyloctadecyl);

2) alkyl groups containing $C_{13-14}$ polymethylene groups, such as 1-$C_{1-15}$ alkyl-tetradecyl groups (e.g. 2-hexyltetradecyl, 2-decyltetradecyl and 2-undecyltridecyl) and 2-$C_{1-15}$ alkyl-hexadecyl groups (e.g. 2-ethyl-hexadecyl and 2-dodecylhexadecyl);

3) alkyl groups containing $C_{10-12}$polymethylene groups, such as 2-$C_{1-15}$ alkyl-dodecyl groups (e.g. 2-octyldodecyl) and 2-$C_{1-15}$ alkyl-dodecyl groups (2-hexyldodecyl and 2-octyldodecyl), 2-$C_{1-15}$ alkyl-tetradecyl groups (e.g. 2-hexyltetradecyl and 2-decyltetradecyl);

4) alkyl groups containing $C_{6-9}$ polymethylene groups, such as 2-$C_{1-15}$ alkyl-decyl groups (e.g. 2-octyldecyl) and 2,4-di-$C_{1-15}$ alkyl-decyl groups (e.g. 2-ethyl-4-butyl-decyl group);

5) alkyl groups containing $C_{1-5}$ polymethylene groups, such as 2-(3-methylhexyl)-7-methyl-decyl and 2-(1,4,4-trimethylbutyl)-5,7,7-trimethyl-octyl groups; and 6) and mixtures of two or more branched alkyl groups, such as alkyl residues of oxoalcohols corresponding to propylene oligomers (from hexamer to undecamer), ethylene/propylene (molar ratio 16:1-1:11) oligomers, iso-butene oligomers (from pentamer to octamer), $C_{5-17}$ α-olefin oligomers (from dimer to hexamer).

Examples of suitable primary alcohol branched at the β- or higher position include 2-ethylhexanol, 2-butyloctanol, 2-hexyldecanol, 2-octyldodecanol, 2-decyltetradecanol, or mixtures thereof.

In one embodiment the alcohol comprises a mixture of (i) a Guerbet alcohol and (ii) a linear alcohol other than a Guerbet alcohol. The other alcohol may be a fatty alcohol described above.

The copolymer of the invention may be esterified in the presence of an alcohol described above. The esterification reaction of the alcohol with the ethylenically unsaturated carboxylic acid or derivatives thereof is outlined below.

Esterified Copolymer: A linear alcohol and a primary alcohol branched at the β- or higher position. The esterified copolymer is prepared in a flask fitted with a Dean-Stark trap capped with a condenser. An amount of copolymer containing 1 mole of carboxy groups is heated in the flask to 110° C. and stirred for 30 minutes. One mole of alcohol is added. If the amount of the primary alcohol branched at the β- or higher position is greater than one mole, only one mole is added at this point. Conversely if less than one mole of the primary alcohol branched at the β- or higher position is present, sufficient linear alcohol is used to provide a total of one mole equivalent of alcohol. The alcohol is pumped into the flask via peristaltic pump over a period of 35 minutes. Catalytic amounts of methane sulphonic acid along with the remaining moles of alcohol are then pumped into the flask over a period of 5 hours whilst heating to and holding at 145° C. and removing water in the Dean-Stark trap.

The reaction temperature is reduced to 135° C., and sufficient butanol is added sequentially to the flask until the total acid number (TAN) is not higher than 4 mg KOH/g. The flask is heated to 150° C. and sufficient sodium hydroxyide is added to quench the methanesulphonic acid. The flask is cooled to ambient temperature resulting in an esterified copolymer.

The procedure may employ the materials listed in the table below.

| Ester Co-polymer | Co-polymer Prep | Moles of Linear Alcohol | Moles of Branched Alcohol B1 | B2 | B3 |
|---|---|---|---|---|---|
| Esc1 | Cpp1 | 1.8 | 0.2 | | |
| Esc2 | Cpp2 | 1.8 | 0.2 | | |
| Esc3 | Cpp3 | 1.8 | 0.2 | | |
| Esc4 | Cpp4 | 1.8 | 0.2 | | |
| Esc5 | Cpp5 | 1.8 | 0.2 | | |
| Esc6 | Cpp6 | 1.8 | 0.2 | | |
| Esc7 | Cpp7 | 1.8 | 0.2 | | |
| Esc8 | Cpp8 | 1.8 | 0.2 | | |
| Esc9 | Cpp8 | 1.6 | | 0.4 | |
| Esc10 | Cpp8 | 1.4 | | | 0.6 |
| Esc11 | Cpp8 | 1.6 | 0.4 | | |
| Esc12 | Cpp8 | 1.4 | | 0.6 | |
| Esc13 | Cpp8 | 1 | | 1 | |
| Esc14 | Cpp1 | 1 | | | 1 |
| Esc15 | Cpp1 | 1 | 1 | | |
| Esc16 | Cpp2 | 0.5 | | | 1.5 |
| Esc17 | Cpp5 | 0 | 2 | | |
| Esc18 | Cpp5 | 0 | | 2 | |
| Esc19 | Cpp5 | 0 | | | 2 |
| Esc20 | Cpp3 | 0 | 2 | | |
| Esc22 | Cpp1 | 0 | 2 | | |
| Esc23 | Cpp8 | 1.4 | 0.6 | | |

Footnote:
The linear alcohol is a $C_{8-10}$ mixture commercially available as Alfol ®810
B1 is 2-hexyldecanol
B2 is 2-ethylhexanol
B3 is a 2-octyldodecanol

Aromatic Amine

The aromatic amine may be a monoamine or a polyamine.

The aromatic amine may include aniline, nitroaniline, aminodiphenylamine, amino-alkylphenothiazines, phenoxyphenylamine (also known as phenoxyaniline), 4-aminodiphenylamine (ADPA), coupled 4-amino diphenylamine, or mixtures thereof.

In one embodiment the amine may be an aromatic amine (typically wherein the aromatic amine is not a heterocycle). The aromatic amine includes aniline, nitro aniline, aminocarbazole, 4-aminodiphenylamine (ADPA), and coupling products of ADPA. In one embodiment the amine may be 4-aminodiphenylamine (ADPA), or coupling products (also referred to as coupled products) of ADPA.

Coupled products of ADPA may be represented by the formula (1):

Formula (1)

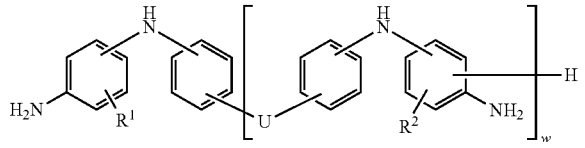

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

In one embodiment the coupled ADPA of Formula (1) may be represented by Formula (1a):

Formula (1a)

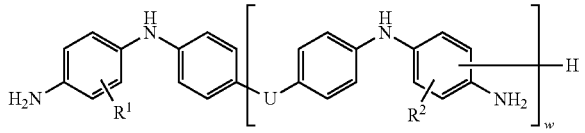

wherein independently each variable, $R^1$ may be hydrogen or a $C_{1-5}$ alkyl group (typically hydrogen);

$R^2$ may be hydrogen or a $C_{1-5}$ alkyl group (typically hydrogen);

U may be an aliphatic, alicyclic or aromatic group, with the proviso that when U is aliphatic, the aliphatic group may be linear or branched alkylene group containing 1 to 5, or 1 to 2 carbon atoms; and w may be 1 to 10, or 1 to 4, or 1 to 2 (typically 1).

Alternatively, the compound of Formula (1a) may also be represented by:

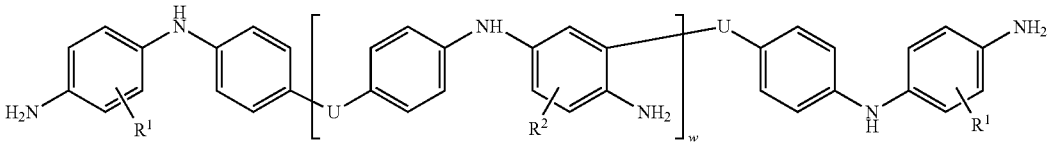

wherein each variable U, $R^1$, and $R^2$ are the same as described above and w is 0 to 9 or 0 to 3 or 0 to 1 (typically 0).

In one embodiment the aromatic amine may have at least 3 or aromatic groups. Examples of an amine having at least 3 aromatic groups may be represented by any of the following Formulae (2) and/or (3):

Formula (2)

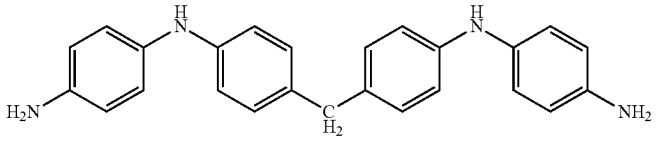

or

Formula (3)

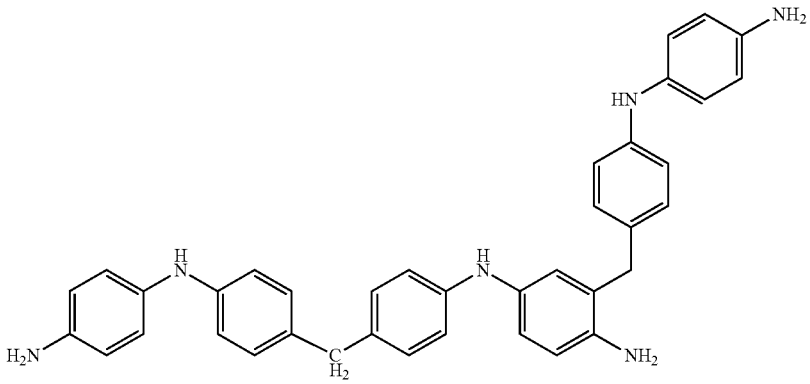

A coupled aromatic amine can be made by the reaction of an aromatic amine with an aldehyde (such as formaldehyde). A person skilled in the art will appreciate that compounds of Formulae (2) and (3) may also react with the aldehyde described below to form acridine derivatives. Acridine derivatives that may be formed include compounds illustrated represented by Formula (2a) or (3a) below. In addition to these compounds represented these formulae, a person skilled in the art will also appreciate that other acridine structures may be possible where the aldehyde reacts with other benzyl groups bridged with the >NH group. Examples of acridine structures include those represented by Formulae (2a) and (3a):

Formula (2a)

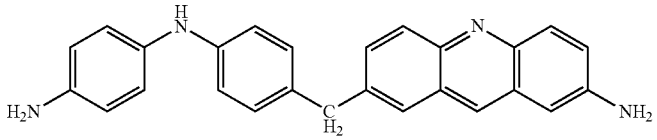

Formula (3a)

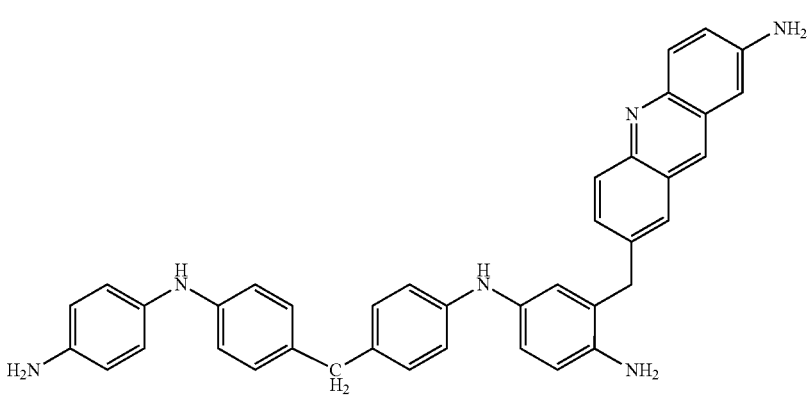

Any or all of the N-bridged aromatic rings are capable of such further condensation and perhaps aromaticisation. One other of many possible structures is shown in Formula (3b).

Formula (3b)

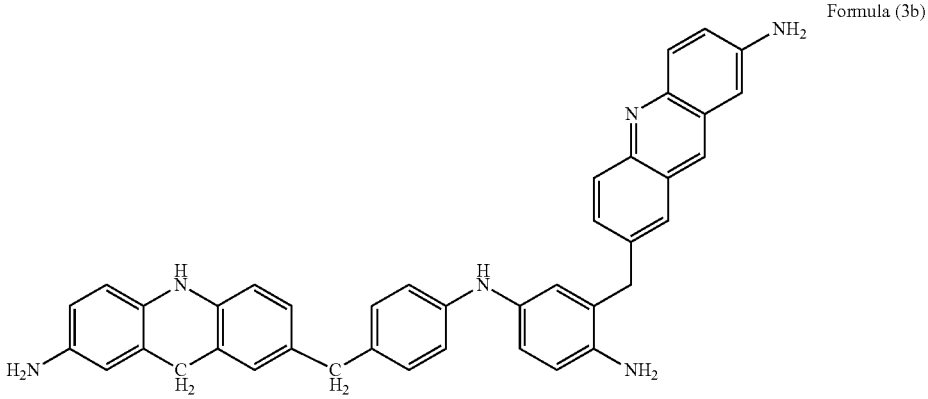

Examples of a coupled ADPA include bis[p-(p-aminoanilino)phenyl]-methane, 2-(7-amino-acridin-2-ylmethyl)-N-4-{4-[4-(4-amino-phenylamino)benzyl]-phenyl}-benzene-1,4-diamine, $N^4$-{4-[4-(4-amino-phenylamino)benzyl]-phenyl}-2-[4-(4-amino-phenylamino)-cyclohexa-1,5-dienylmethyl]-benzene-1,4-diamine, N-[4-(7-amino-acridin-2-ylmethyl)-phenyl]-benzene-1,4-diamine, or mixtures thereof.

The coupled ADPA may be prepared by a process comprising reacting the aromatic amine with an aldehyde. The aldehyde may be aliphatic, alicyclic or aromatic. The aliphatic aldehyde may be linear or branched. Examples of a suitable aromatic aldehyde include benzaldehyde or o-vanillin. Examples of an aliphatic aldehyde include formaldehyde (or a reactive equivalent thereof such as formalin or paraformaldehyde), ethanal or propanal. Typically the aldehyde may be formaldehyde or benzaldehyde.

The process may be carried out at a reaction temperature in the range of 40° C. to 180° C., or 50° C. to 170° C.

The reaction may or may not be carried out in the presence of a solvent. Examples of a suitable solvent include diluent oil, benzene, t-butyl benzene, toluene, xylene, chlorobenzene, hexane, tetrahydrofuran, water, or mixtures thereof.

The reaction may be performed in either air or an inert atmosphere. Examples of suitable inert atmosphere include nitrogen or argon, typically nitrogen.

Alternatively, the coupled ADPA may also be prepared by the methodology described in Berichte der Deutschen Chemischen Gesellschaft (1910), 43, 728-39.

The aromatic amine may be derived from dye intermediates containing multiple aromatic rings linked by, for example, amide structures. Examples include materials of the general Formula (4):

Formula (4)

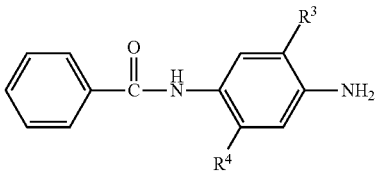

and isomeric variations thereof, where $R^3$ and $R^4$ are independently alkyl or alkoxy groups such as methyl, methoxy, or ethoxy. In one instance, $R^4$ and $R^3$ are both —$OCH_3$ and the material is known as Fast Blue RR [CAS Number 6268-05-9]. The orientation of the linking amido group may be reversed, to —NR—C(O)—.

In another instance, $R^4$ is —$OCH_3$ and $R^3$ is —$CH_3$, and the material is known as Fast Violet B [99-21-8]. When both $R^3$ and $R^4$ are ethoxy, the material is Fast Blue BB [120-00-3]. U.S. Pat. No. 5,744,429 discloses other capping amine compounds, particularly amino alkylphenothiazines. N-aromatic substituted acid amide compounds, such as those disclosed in U.S. Patent Application 2003/0030033 A1, may also be used for the purposes of this invention. Suitable capping amines include those in which the amine nitrogen is a substituent on an aromatic carbocyclic compound, that is, the nitrogen is not $sp^2$ hybridised within an aromatic ring.

In one embodiment the copolymer is further reacted with a non-aromatic amine, or mixtures thereof. In certain embodiments the non-aromatic amine may be introduced of an amine-containing monomer by copolymerisation or by grafting.

The non-aromatic amine (or monomer) may include N,N-dimethylacrylamide, N-vinyl carbonamides (such as, N-vinyl-formamide, N-vinylacetoamide, N-vinyl propionamides, N-vinyl hydroxyacetoamide, vinyl pyridine, N-vinyl imidazole, N-vinyl pyrrolidinone, N-vinyl caprolactam, dimethylamino ethyl acrylate, dimethylamino ethyl methacrylate, dimethylaminobutylacrylamide, dimethylaminopropyl methacrylate, dimethylaminopropylacrylamide, dimethylaminopropylmethacrylamide, dimethylaminoethylacrylamide or mixtures thereof.

The non-aromatic amine may also include morpholines, pyrrolidinones, imidazolidinones, aminoalkyl amides such as acetamides, β-alanine alkyl esters, or mixtures thereof. Examples of suitable nitrogen-containing compounds include 3-morpholin-4-yl-propylamine, 3-morpholin-4-yl-ethylamine, β-alanine alkyl esters (typically alkyl esters have 1 to 30, or 6 to 20 carbon atoms), or mixtures thereof.

In one embodiment the imidazolidinones, cyclic carbamates or pyrrolidinones may be derived from a compound of general structure:

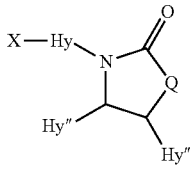

wherein

X=—OH or —$NH_2$;

Hy" is hydrogen, or a hydrocarbyl group (typically alkyl, or $C_{1-4}$-, or $C_2$-alkyl);

Hy is a hydrocarbylene group (typically alkylene, or $C_{1-4}$-, or $C_2$-alkylene);

Q=>NH, >NR, >$CH_2$, >CHR, >$CR_2$, or —O— (typically >NH, or >NR) and

R is $C_{1-4}$ alkyl.

In one embodiment the imidazolidinone includes 1-(2-amino-ethyl)imidazolidin-2-one (may also be called amino-ethylethyleneurea), 1-(3-aminopropyl)-imidazolidin-2-one, 1-(2-hydroxy-ethyl)-imidazolidin-2-one, 1-(3-aminopropyl)-pyrrolidin-2-one, 1-(3-amino-ethyl)-pyrrolidin-2-one, or mixtures thereof.

In one embodiment the amide such as acetamide may be represented by the general structure:

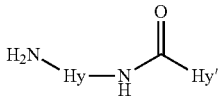

wherein

Hy is a hydrocarbylene group (typically alkylene, or $C_{1-4}$-, or $C_2$-alkylene); and Hy' is a hydrocarbyl group (typically alkyl, or $C_{1-4}$-alkyl, or methyl).

Examples of a suitable acetamide include N-(2-amino-ethyl)acetamide, or N-(2-amino-propyl)-acetamide.

In one embodiment the β-alanine alkyl esters may be represented by the general structure:

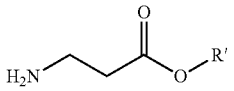

wherein

R' is a an alkyl group having 1 to 30, or 6 to 20 carbon atoms.

Examples of suitable β-alanine alkyl esters include β-alanine octyl ester, β-alanine decyl ester, β-alanine 2-ethylhexyl ester, β-alanine dodecyl ester, β-alanine tetradecyl ester, or β-alanine hexadecyl ester.

In one embodiment the copolymer may be reacted with an amine selected from the group consisting of 1-(2-amino-ethyl)-imidazolidin-2-one, 4-(3-aminopropyl)morpholine, 3-(dimethylamino)-1-propylamine, N-phenyl-p-phenylene-diamine, N-(3-aminopropyl)-2-pyrrolidinone, aminoethyl acetamide, β-alanine methyl ester, 1-(3-aminopropyl) imidazole, and mixtures thereof.

The copolymer of the invention may be reacted with an amine as is shown below.

Preparative Example of an Esterified Copolymer Reacted with an Amine (Ecca): Each esterified copolymer from above is reacted with an amine in a flask fitted with a Dean-Stark trap capped with a condenser. Sufficient amine is added to provide the esterified copolymer with a weight percent nitrogen content as is shown in the table below. The amine is charged into the flask over a period of 30 minutes and stirred for 16 hours at 150° C. The flask is cooled to 115° C. and drained. The resultant product is vacuum stripped at 150° C. and held for 2.5 hours. The procedure employs the materials listed in the table below. The table below presents the information for a representative number of esterified copolymers capped with an amine mixture. In each case the amine mixtures are prepared using ratios of the first-identified amine and the ADPA in separate weight ratios of 10:1, 4:1, 3:1, 1:1, 1:3, 1:4, and 1:10. Ratios within these ranges may be used generally for the optional non-aromatic amine and the aromatic amine.

| Ecca | Esterified Co-polymer | Amine | Nitrogen Content (wt %) |
|---|---|---|---|
| Ecca1 | Esc1 | 1 | 0.1 |
| Ecca2 | Esc1 | 2 | 0.1 |
| Ecca3 | Esc1 | 3 | 0.1 |
| Ecca4 | Esc1 | 4 | 0.1 |
| Ecca5 | Esc2 | 5 | 0.1 |
| Ecca6 | Esc3 | 6 | 0.1 |
| Ecca7 | Esc4 | 7 | 0.1 |
| Ecca8 | Esc5 | 8 | 0.1 |
| Ecca9 | Esc8 | 1 | 0.4 |
| Ecca10 | Esc9 | 2 | 0.4 |
| Ecca11 | Esc10 | 3 | 0.4 |
| Ecca12 | Esc11 | 1 | 0.4 |
| Ecca13 | Esc12 | 5 | 0.4 |
| Ecca14 | Esc13 | 5 | 0.4 |
| Ecca15 | Esc14 | 2 | 0.1 |
| Ecca16 | Esc15 | 1 | 0.1 |
| Ecca17 | Esc1 | 1 | 0.2 |
| Ecca18 | Esc7 | 2 | 0.1 |
| Ecca19 | Esc10 | 3 | 0.1 |
| Ecca20 | Esc11 | 4 | 0.1 |
| Ecca21 | Esc13 | 5 | 0.1 |
| Ecca22 | Esc14 | 6 | 0.1 |
| Ecca23 | Esc15 | 7 | 0.1 |
| Ecca24 | Esc16 | 8 | 0.1 |
| Ecca25 | Esc19 | 1 | 0.1 |
| Ecca26 | Esc20 | 3 | 0.1 |
| Ecca27 | Esc21 | 2 | 0.1 |
| Ecca28 | Esc14 | 1 | 0.1 |
| Ecca29 | Esc22 | 1 | 0.1 |
| Ecca30 | Esc23 | 2 | 0.1 |
| Ecca31 | Esc8 | 2 | 0.1 |

Footnote:

Amine 1 is 1-(2-amino-ethyl)-imidazolidin-2-one and ADPA

Amine 2 is 4-(3-aminopropyl)morpholine and ADPA

Amine 3 is 3-(dimethylamino)-1-propylamine and ADPA

Amine 4 is N-phenyl-p-phenylenediamine and ADPA

Amine 5 is N-(3-Aminopropyl)-2-pyrrolidinone and ADPA

Amine 6 is Aminoethyl acetamide and ADPA

Amine 7 is β-alanine methyl ester and ADPA

Amine 8 is 1-(3-aminopropyl) imidazole and ADPA

Oils of Lubricating Viscosity

The lubricating composition comprises an oil of lubricating viscosity. Such oils include natural and synthetic oils, oil derived from hydrocracking, hydrogenation, and hydrofinishing, unrefined, refined, re-refined oils or mixtures thereof. A more detailed description of unrefined, refined and re-refined oils is provided in International Publication WO2008/147704, paragraphs [0054] to [0056] and in the corresponding paragraphs of US-2010-0197536. A more detailed description of natural and synthetic lubricating oils is described in paragraphs [0058] to [0059] respectively of WO2008/147704. Synthetic oils may also be produced by Fischer-Tropsch reactions and typically may be hydroisomerised Fischer-Tropsch hydrocarbons or waxes. In one embodiment oils may be prepared by a Fischer-Tropsch gas-to-liquid synthetic procedure as well as other gas-to-liquid oils.

Oils of lubricating viscosity may also be defined as specified in April 2008 version of "Appendix E—API Base Oil Interchangeability Guidelines for Passenger Car Motor Oils and Diesel Engine Oils", section 1.3 Sub-heading 1.3. "Base Stock Categories". In one embodiment the oil of lubricating viscosity may be an API Group II or Group III oil.

The amount of the oil of lubricating viscosity present is typically the balance remaining after subtracting from 100 wt % the sum of the amount of the compound of the invention and the other performance additives.

The lubricating composition may be in the form of a concentrate and/or a fully formulated lubricant. If the lubricating composition of the invention (comprising the additives disclosed herein) is in the form of a concentrate which may be combined with additional oil to form, in whole or in part, a finished lubricant), the ratio of the of these additives to the oil of lubricating viscosity and/or to diluent oil include the ranges of 1:99 to 99:1 by weight, or 80:20 to 10:90 by weight.

A lubricating composition may be prepared by adding the product of the process described herein to an oil of lubricating viscosity, optionally in the presence of other performance additives (as described herein below).

Other Performance Additives

The composition optionally comprises other performance additives. The other performance additives include at least one of metal deactivators, viscosity modifiers, detergents, friction modifiers, antiwear agents, corrosion inhibitors, dispersants, dispersant viscosity modifiers (other than the compound of the invention), extreme pressure agents, antioxidants, foam inhibitors, demulsifiers, pour point depressants, seal swelling agents and mixtures thereof. Typically, fully-formulated lubricating oil will contain one or more of these performance additives.

In one embodiment the lubricating composition further includes other additives. In one embodiment the invention provides a lubricating composition further comprising at least one of a dispersant, an antiwear agent, a dispersant viscosity modifier (other than the compound of the invention), a friction modifier, a viscosity modifier, an antioxidant, an overbased detergent, or mixtures thereof. In one embodiment the invention provides a lubricating composition further comprising at least one of a polyisobutylene succinimide dispersant, an antiwear agent, a dispersant viscosity modifier, a friction modifier, a viscosity modifier (typically an olefin copolymer such as an ethylene-propylene copolymer), an antioxidant (including phenolic and aminic antioxidants), an overbased detergent (including overbased sulphonates and phenates), or mixtures thereof.

The dispersant may be a succinimide dispersant, or mixtures thereof. In one embodiment the dispersant may be present as a single dispersant. In one embodiment the dispersant may be present as a mixture of two or three different dispersants, wherein at least one may be a succinimide dispersant.

The succinimide dispersant may be derived from an aliphatic polyamine, or mixtures thereof. The aliphatic polyamine may be aliphatic polyamine such as an ethylenepolyamine, a propylenepolyamine, a butylenepolyamine, or mixtures thereof. In one embodiment the aliphatic polyamine may be ethylenepolyamine. In one embodiment the aliphatic polyamine may be selected from the group consisting of ethylenediamine, diethylenetriamine, triethylenetetramine, tetraethylenepentamine, pentaethylenehexamine, polyamine still bottoms, and mixtures thereof.

The dispersant may be an N-substituted long chain alkenyl succinimide. A example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for instance in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

The dispersant may also be post-treated by conventional methods by a reaction with any of a variety of agents. Among these are boron compounds, urea, thiourea, dimercaptothiadiazoles, carbon disulphide, aldehydes, ketones, carboxylic acids, hydrocarbon-substituted succinic anhydrides, maleic anhydride, nitriles, epoxides, and phosphorus compounds.

The dispersant may be present at 0.01 wt % to 20 wt %, or 0.1 wt % to 15 wt %, or 0.1 wt % to 10 wt %, or 1 wt % to 6 wt %, or 1 wt % to 3 wt % of the lubricating composition.

In one embodiment the lubricating composition of the invention further comprises a dispersant viscosity modifier (other than the copolymer of the present invention). The dispersant viscosity modifier may be present at 0 wt % to 5 wt %, or 0 wt % to 4 wt %, or 0.05 wt % to 2 wt %, or 0.2 wt % to 1.2 wt % of the lubricating composition.

The dispersant viscosity modifier may include functionalised polyolefins, for example, ethylene-propylene copolymers that have been functionalized with an acylating agent such as maleic anhydride and an amine; polymethacrylates functionalised with an amine, or styrene-maleic anhydride copolymers reacted with an amine. More detailed description of dispersant viscosity modifiers are disclosed in International Publication WO2006/015130 or U.S. Pat. Nos. 4,863,623; 6,107,257; 6,107,258; and 6,117,825. In one embodiment the dispersant viscosity modifier may include those described in U.S. Pat. No. 4,863,623 (see column 2, line 15 to column 3, line 52) or in International Publication WO2006/015130 (see page 2, paragraph [0008] and preparative examples are described paragraphs [0065] to [0073]).

In one embodiment the invention provides a lubricating composition which further includes a phosphorus-containing antiwear agent. Typically the phosphorus-containing antiwear agent may be a zinc dialkyldithiophosphate, a phosphite, phosphate, phosphonate, ammonium phosphate salts, or mixtures thereof. Zinc dialkyldithiophosphates are known in the art. The antiwear agent may be present at 0 wt % to 3 wt %, or 0.1 wt % to 1.5 wt %, or 0.5 wt % to 0.9 wt % of the lubricating composition.

In one embodiment the invention provides a lubricating composition further comprising a molybdenum compound. The molybdenum compound may be selected from the group consisting of molybdenum dialkyldithiophosphates, molybdenum dithiocarbamates, amine salts of molybdenum compounds, and mixtures thereof. The molybdenum compound may provide the lubricating composition with 0 to 1000 ppm, or 5 to 1000 ppm, or 10 to 750 ppm 5 ppm to 300 ppm, or 20 ppm to 250 ppm of molybdenum.

In one embodiment the invention provides a lubricating composition further comprising an overbased metal-containing detergent. The metal of the metal-containing detergent may be zinc, sodium, calcium or magnesium.

The overbased metal-containing detergent may be selected from the group consisting of non-sulphur containing phenates, sulphur containing phenates, sulphonates, salixarates, salicylates, and mixtures thereof.

The overbased metal-containing detergent may also include "hybrid" detergents formed with mixed surfactant systems including phenate and/or sulphonate components, e.g. phenate/salicylates, sulphonate/phenates, sulphonate/salicylates, sulphonates/phenates/salicylates, as described; for example, in U.S. Pat. Nos. 6,429,178; 6,429,179; 6,153,565; and 6,281,179. Where, for example, a hybrid sulphonate/phenate detergent is employed, the hybrid detergent would be considered equivalent to amounts of distinct phenate and sulphonate detergents introducing like amounts of phenate and sulphonate soaps, respectively.

Typically an overbased metal-containing detergent may be a zinc, sodium, calcium or magnesium salt of a phenate, sulphur containing phenate, sulphonate, salixarate or salicylate. Overbased salixarates, phenates and salicylates typically have a total base number of 180 to 450 TBN. Overbased sulphonates typically have a total base number of 250 to 600, or 300 to 500. Overbased detergents are known in the art. In one embodiment the sulphonate detergent may be a predominantly linear alkylbenzene sulphonate detergent having a metal ratio of at least 8 as is described in paragraphs [0026] to [0037] of US Patent Application 2005065045 (and granted as U.S. Pat. No. 7,407,919). The predominantly linear alkylbenzene sulphonate detergent may be particularly useful for assisting in improving fuel economy.

Typically the overbased metal-containing detergent may be a calcium or magnesium overbased detergent.

Overbased detergents are known in the art. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. The term "metal ratio is also explained in standard textbook entitled "Chemistry and Technology of Lubricants", Second Edition, Edited by R. M. Mortier and S. T. Orszulik, Copyright 1997. In one embodiment, the lubricant composition at least one overbased detergent with a metal ratio of at least 3, or at least 8, or at least 15.

The overbased detergent may be present at 0 wt % to 15 wt %, or 0.1 wt % to 10 wt %, or 0.2 wt % to 8 wt %, or 0.2 wt % to 3 wt %. For example in a heavy duty diesel engine the detergent may be present at 2 wt % to 3 wt % of the lubricating composition. For a passenger car engine the detergent may be present at 0.2 wt % to 1 wt % of the lubricating composition.

In one embodiment the lubricating composition includes an antioxidant, or mixtures thereof. The antioxidant may be present at 0 wt % to 15 wt %, or 0.1 wt % to 10 wt %, or 0.5 wt % to 5 wt % of the lubricating composition.

Antioxidants include sulphurised olefins, alkylated diphenylamines (as described previously), hindered phenols, molybdenum compounds (such as molybdenum dithiocarbamates), or mixtures thereof.

The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 from Ciba. A more detailed description of suitable ester-containing hindered phenol antioxidant chemistry is found in U.S. Pat. No. 6,559,105.

In one embodiment the friction modifier may be selected from the group consisting of long chain fatty acid derivatives of amines, long chain fatty esters, or long chain fatty epoxides; fatty imidazolines; amine salts of alkylphosphoric acids; fatty alkyl tartrates; fatty alkyl tartrimides; and fatty alkyl tartramides. The friction modifier may be present at 0 wt % to 6 wt %, or 0.05 wt % to 4 wt %, or 0.1 wt % to 2 wt % of the lubricating composition.

Friction modifiers may also encompass materials such as sulphurised fatty compounds and olefins, molybdenum dialkyldithiophosphates, molybdenum dithiocarbamates, sunflower oil or monoester of a polyol and an aliphatic carboxylic acid.

In one embodiment the friction modifier may be selected from the group consisting of long chain fatty acid derivatives of amines (such as oleylamide), fatty esters, or fatty epoxides; fatty alkyl tartrates; fatty alkyl tartrimides; and fatty alkyl tartramides. The friction modifier may be selected from fatty alkyl tartrates; fatty alkyl tartrimides; and fatty alkyl tartramides.

As used herein the term "fatty alkyl" means a carbon chain having 10 to 22 carbon atoms, typically an unbranched carbon chain which may or may not be unsaturated In one embodiment the friction modifier may be a long chain fatty acid ester. In another embodiment the long chain fatty acid ester may be a mono-ester and in another embodiment the long chain fatty acid ester may be a triglyceride.

Other performance additives such as corrosion inhibitors include those described in paragraphs 5 to 8 of WO2006/047486, octylamine octanoate, condensation products of dodecenyl succinic acid or anhydride and a fatty acid such as oleic acid with a polyamine. In one embodiment the corrosion inhibitors include the Synalox® corrosion inhibitor. The Synalox® corrosion inhibitor may be a homopolymer or copolymer of propylene oxide. The Synalox® corrosion inhibitor is described in more detail in a product brochure with Form No. 118-01453-0702 AMS, published by The Dow Chemical Company. The product brochure is entitled "SYNALOX Lubricants, High-Performance Polyglycols for Demanding Applications."

Metal deactivators including derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides may be useful. Foam inhibitors that may be useful in the compositions of the invention include copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers.

Pour point depressants that may be useful in the compositions of the invention include polyalphaolefins, esters of maleic anhydride-styrene copolymers, poly(meth)acrylates, polyacrylates or polyacrylamides.

In different embodiments the lubricating composition may have a composition as described in the following table:

| | Embodiments (wt %) | | |
|---|---|---|---|
| Additive | A | B | C |
| Copolymer of the Invention | 1 to 65 | 2 to 60 | 2 to 20 |
| Dispersant | 0 to 12 | 0 to 8 | 0.5 to 6 |
| Dispersant Viscosity Modifier | 0 to 5 | 0 to 4 | 0.05 to 2 |
| Overbased Detergent | 0 to 15 | 0.1 to 10 | 0.2 to 8 |
| Antioxidant | 0 to 13 | 0.1 to 10 | 0.5 to 5 |
| Antiwear Agent | 0 to 15 | 0.1 to 10 | 0.3 to 5 |
| Friction Modifier | 0 to 6 | 0.05 to 4 | 0.1 to 2 |
| Viscosity Modifier | 0 to 10 | 0.5 to 8 | 1 to 6 |
| Any Other Performance Additive | 0 to 10 | 0 to 8 | 0 to 6 |
| Oil of Lubricating Viscosity | Balance to 100% | Balance to 100% | Balance to 100% |

Industrial Application

The lubricating composition may be utilised in an internal combustion engine. The engine components may have a surface of steel or aluminium (typically a surface of steel).

An aluminium surface may be derived from an aluminium alloy that may be a eutectic or hyper-eutectic aluminium alloy (such as those derived from aluminium silicates, aluminium oxides, or other ceramic materials). The aluminium surface may be present on a cylinder bore, cylinder block, or piston ring having an aluminium alloy, or aluminium composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

In one embodiment the internal combustion engine may be a diesel fuelled engine (typically a heavy duty diesel engine), a gasoline fuelled engine, a natural gas fuelled engine or a mixed gasoline/alcohol fuelled engine. In one embodiment the internal combustion engine may be a diesel fuelled engine and in another embodiment a gasoline fuelled engine. In one embodiment the internal combustion engine may be a heavy duty diesel engine. In one embodiment the internal combustion engine may be a heavy duty diesel engine equipped with exhaust gas recirculation.

The internal combustion engine may be a 2-stroke or 4-stroke engine. Suitable internal combustion engines include marine diesel engines, aviation piston engines, low-load diesel engines, and automobile and truck engines.

The lubricant composition for an internal combustion engine may be suitable for any engine lubricant irrespective of the sulphur, phosphorus or sulphated ash (ASTM D-874) content. The sulphur content of the engine oil lubricant may be 1 wt % or less, or 0.8 wt % or less, or 0.5 wt % or less, or 0.3 wt % or less. In one embodiment the sulphur content may be in the range of 0.001 wt % to 0.5 wt %, or 0.01 wt % to 0.3 wt %. The phosphorus content may be 0.2 wt % or less, or 0.12 wt % or less, or 0.1 wt % or less, or 0.085 wt % or less, or 0.08 wt % or less, or even 0.06 wt % or less, 0.055 wt % or less, or 0.05 wt % or less. In one embodiment the phosphorus content may be 0.4 wt % to 0.12 wt %. In one embodiment the phosphorus content may be 100 ppm to 1000 ppm, or 200 ppm to 600 ppm. The total sulphated ash content may be 0.3 wt % to 1.2 wt %, or 0.5 wt % to 1.1 wt % of the lubricating composition. In one embodiment the sulphated ash content may be 0.5 wt % to 1.1 wt % of the lubricating composition.

In one embodiment the lubricating composition may be an engine oil, wherein the lubricating composition may be characterised as having at least one of (i) a sulphur content of 0.5 wt % or less, (ii) a phosphorus content of 0.12 wt % or less, and (iii) a sulphated ash content of 0.5 wt % to 1.1 wt % of the lubricating composition.

The following examples provide illustrations of the invention. These examples are non-exhaustive and are not intended to limit the scope of the invention.

EXAMPLES

Preparative Example 1 (EX1)

1611 g of Esc10 (as described above) is charged into a 3 L flask with a catalytic amount of methane sulphonic acid. The flask is fitted with a flange lid and clip, PTFE stirrer gland, rod and overhead stirrer, thermocouple with Eurotherm™ heating system, nitrogen inlet and a Dean and Stark trap capped with a condenser. Nitrogen was applied 472 $cm^3$ $min^{-1}$ (or about 1 SCFH) and the flask was heated to 150° C. with stirring at 310 rpm. Butanol (37.6 g) is charged subsurface and stirred for 2 hours. Further butanol (37.6 g) is charged to the flask subsurface and the mixture is stirred for 2 hours. Further butanol was charged (37 g) and the flask is maintained at 150° C. A sodium hydroxide solution (40.6 mol % NaOH in $H_2O$) is added to quench the methane sulphonic acid and stirred for one hour. 4-aminodiphenylamine is added in an amount to deliver to the final copolymer 0.1 wt % of nitrogen. The flask was then cooled to 105° C. The resultant copolymer is then vacuum distilled using a water-cooled condenser, vacuum receiver adapter and 1 L receiving flask. Vacuum is applied and the temperature was increased to 150° C. and held for 3.5 hours. The flask is then cooled to 100° C., vacuum removed and the product is filtered twice through a FAX5 filter. The resultant product is a brown viscous liquid.

Preparative Example 2 (EX2)

is similar to EX1, except 4-aminodiphenylamine and 4-(3-aminopropyl)morpholine are both added in an amount sufficient to provide 0.68 wt % of nitrogen to the copolymer.

It is known that some of the materials described above may interact in the final formulation, so that the components of the final formulation may be different from those that are initially added. The products formed thereby, including the products formed upon employing lubricant composition of the present invention in its intended use, may not be susceptible of easy description. Nevertheless, all such modifications and reaction products are included within the scope of the present invention; the present invention encompasses lubricant composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention may be used together with ranges or amounts for any of the other elements.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include: hydrocarbon substituents, including aliphatic, alicyclic, and aromatic substituents; substituted hydrocarbon substituents, that is, substituents containing non-hydrocarbon groups which, in the context of this invention, do not alter the predominantly hydrocarbon nature of the substituent; and hetero substituents, that is, substituents which similarly have a predominantly hydrocarbon character but contain other than carbon in a ring or chain. A more detailed definition of the term "hydrocarbyl substituent" or "hydrocarbyl group" is described in paragraphs [0118] to [0119] of International Publication WO2008147704.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A lubricating composition comprising an oil of lubricating viscosity and 0.1 wt % to 70 wt % of a copolymer comprising units derived from monomers (i) an α-olefin and (ii) an ethylenically unsaturated carboxylic acid or derivatives thereof, esterified and amidated with an alcohol and an aromatic amine respectively, wherein the copolymer is obtained by a process comprising:

(1) reacting monomers (i) an α-olefin and (ii) an ethylenically unsaturated carboxylic acid or derivatives thereof to form a copolymer;

(2) reacting the product of step (1) with an aromatic amine selected from coupling products of 4-aminodiphenylamine; and (3) reacting the copolymer of step (2) with an alcohol, to form a copolymer that is amidated and esterified.

2. The lubricating composition of claim 1, wherein the α-olefin is linear having 8 to 12 carbon atoms.

3. The lubricating composition of claim 1, wherein the α-olefin is branched having 8 to 16 carbon atoms.

4. The lubricating composition of claim 1, wherein the α-olefin is selected from 1-decene, 1-undecene, 1-dodecene, 1tridecene, 1-tetradecene, 1-pentadecene, 1-hexadecene, 1-heptadecene 1-octadecene, or mixtures thereof; typically the α-olefin is 1-dodence.

5. The lubricating composition of claim 1, wherein the ethylenically unsaturated carboxylic acid or derivatives thereof is selected from itaconic anhydride, maleic anhydride, methyl maleic anhydride, ethyl maleic anhydride, dimethyl maleic anhydride, (meth)acrylic acid, or mixtures thereof.

6. The lubricating composition of claim 1, wherein the process further comprises reacting a non-aromatic amine in step (3) and (2) respectively, or optionally after step (3) in either case.

7. The lubricating composition of claim 1, wherein the copolymer, prior to amidation and esterification, has a reduced specific viscosity of 0.015 to 0.12.

8. The lubricating composition of claim 1, wherein the copolymer, prior to amidation and esterification, has a reduced specific viscosity of 0.04 to 0.06.

9. The lubricating composition of claim 1, wherein the aromatic amine is present in an amount sufficient to provide the copolymer of the invention with 0.01 wt % to 2 wt % of nitrogen.

10. The lubricating composition of claim 1, wherein the copolymer is present at 2 wt % to 20 wt % of the lubricating composition.

11. The lubricating composition of claim 1, wherein the lubricating composition has a sulphated ash content of 0.3 wt % to 1.2 wt % of the lubricating composition.

12. The lubricating composition of claim 1 further comprising an overbased metal-containing detergent, wherein the overbased metal-containing detergent is selected from the group consisting of non-sulphur containing phenates, sulphur containing phenates, sulphonates, salixarates, salicylates, and mixtures thereof.

13. A method of lubricating an internal combustion engine comprising supplying to the internal combustion engine a lubricating composition comprising the lubricating composition of claim 1.

* * * * *